US007867060B2

(12) United States Patent
Aritomo et al.

(10) Patent No.: US 7,867,060 B2
(45) Date of Patent: Jan. 11, 2011

(54) RETAINER RING USED FOR POLISHING A STRUCTURE FOR MANUFACTURING MAGNETIC HEAD, AND POLISHING METHOD USING THE SAME

(75) Inventors: Hiroki Aritomo, Tokyo (JP); Tetsuji Hori, Tokyo (JP); Akira Miyasaka, Tokyo (JP); Youji Hirao, Tokyo (JP)

(73) Assignee: TDK Corporation, Tokyo (JP)

( * ) Notice: Subject to any disclaimer, the term of this patent is extended or adjusted under 35 U.S.C. 154(b) by 24 days.

(21) Appl. No.: 12/078,438

(22) Filed: Mar. 31, 2008

(65) Prior Publication Data

US 2009/0247060 A1 Oct. 1, 2009

(51) Int. Cl.
*B24B 1/00* (2006.01)

(52) U.S. Cl. ..... 451/36; 451/41; 451/59; 451/288; 451/442

(58) Field of Classification Search ..... 216/89; 438/691, 692; 451/36, 41, 59, 63, 285, 286, 451/287, 288, 289, 290, 442
See application file for complete search history.

(56) References Cited

U.S. PATENT DOCUMENTS 6,273,803 B1 * 8/2001 Wang et al. ..... 451/288
6,390,904 B1 * 5/2002 Gleason et al. ..... 451/286
6,654,205 B1 * 11/2003 O'Hara et al. ..... 360/236.3
7,210,991 B1 * 5/2007 Van Der Veen et al. ..... 451/285
7,520,955 B1 * 4/2009 Zuniga et al. ..... 156/345.14
7,534,364 B2 * 5/2009 Zuniga et al. ..... 216/88
2007/0232203 A1 * 10/2007 Fukuda et al. ..... 451/56
2008/0067429 A1 * 3/2008 Fuse et al. ..... 250/492.2

FOREIGN PATENT DOCUMENTS

| | | | |
|---|---|---|---|
| JP | A-8-187657 | | 7/1996 |
| JP | 2000052241 | A * | 2/2000 |
| JP | A-2000-52241 | | 2/2000 |
| JP | A 2000-84836 | | 3/2000 |
| JP | A 2002-355753 | | 12/2002 |
| JP | A 2006-4992 | | 1/2006 |
| JP | A 2007-301713 | | 11/2007 |

* cited by examiner

*Primary Examiner*—Timothy V Eley
(74) *Attorney, Agent, or Firm*—Oliff & Berridge, PLC

(57) ABSTRACT

Disclosed is a polishing method for polishing a surface of a structure for magnetic-head manufacture by CMP in the process of manufacturing a magnetic head using a ceramic substrate made of a ceramic material containing AlTiC, the structure including the ceramic substrate and one or more layers formed thereon, and having the surface to be polished. The polishing method uses a retainer ring made of a ceramic material containing AlTiC.

6 Claims, 3 Drawing Sheets

RETAINER RING USED FOR POLISHING A STRUCTURE FOR MANUFACTURING MAGNETIC HEAD, AND POLISHING METHOD USING THE SAME

BACKGROUND OF THE INVENTION

1. Field of the Invention

The present invention relates to a retainer ring used for retaining a structure for manufacturing a magnetic head when a surface of the structure is polished by chemical mechanical polishing in the process of manufacturing the magnetic head using a ceramic substrate made of a ceramic material containing alumina-titanium carbide, the structure including the ceramic substrate and one or more layers formed thereon, and to a method of polishing the structure by using the retainer ring.

2. Description of the Related Art

Typically, a magnetic head for use in a magnetic read/write apparatus has such a structure that a read head having a magnetoresistive element (hereinafter also referred to as an MR element) for reading and a write head having an induction-type electromagnetic transducer for writing are stacked on a substrate. The substrate of the magnetic head is typically formed of alumina-titanium carbide ($Al_2O_3$—TiC, hereinafter also referred to as AlTiC), a type of ceramic.

An example of a method of manufacturing the magnetic head will now be described. In this method, first, components of a plurality of magnetic heads are formed on a single substrate of AlTiC to thereby fabricate a magnetic head substructure in which a plurality of pre-head portions that will become the respective magnetic heads later are aligned in a plurality of rows. Next, the substructure is cut into a plurality of head aggregates each of which includes a plurality of pre-head portions aligned in a row. Next, a surface formed in each head aggregate by cutting the substructure is lapped to thereby form medium facing surfaces of the pre-head portions included in each head aggregate. Next, flying rails are formed in the medium facing surfaces. Next, each head aggregate is cut so that the plurality of pre-head portions are separated from one another, whereby the plurality of magnetic heads are formed.

In the process of manufacturing the magnetic head using an AlTiC substrate, components of a plurality of magnetic heads are formed on the AlTiC substrate through various wafer processes, as in the case of manufacturing a semiconductor device using a silicon wafer. Here, a structure including the substrate and one or more layers formed thereon that is formed in the process of manufacturing the magnetic head is referred to as a structure for magnetic-head manufacture. One of the above-mentioned wafer processes is a process of polishing a surface of the structure for magnetic-head manufacture and thereby planarizing the surface. For example, chemical mechanical polishing (hereinafter also referred to as CMP) is employed for this process.

A polishing apparatus for CMP includes a polishing pad and a polishing head disposed on the polishing pad. The polishing pad is provided on a platen, and is driven to rotate together with the platen, or formed into a belt-shape and driven in a horizontal direction. The polishing head includes a retainer ring that is disposed on the polishing pad to retain a workpiece to be polished. For CMP with this polishing apparatus, a polishing slurry is placed on the polishing pad so that the workpiece is polished with the polishing pad and the polishing slurry.

While retaining the workpiece to be polished, the retainer ring itself undergoes polishing at the same time as the workpiece does. Thus, the retainer ring needs to be replaced after a certain period of use. Generally, the running costs of a polishing process by CMP are mostly the costs of consumable supplies such as polishing slurries, polishing pads, retainer rings, dressers, and so on. Desirable characteristics of materials used for the retainer rings as a consumable item are therefore maximum resistance to abrasion in the polishing process and capability of minimizing chipping damage or contamination to the workpiece being polished. From this point of view, polyphenylene sulfide resin (hereinafter referred to as PPS) and polyetheretherketone resin (hereinafter referred to as PEEK) are commonly used for retainer rings for CMP performed in the process of manufacturing semiconductor devices. Retainer rings made of these materials are disclosed in, for example, JP 2000-84836A.

A most typical method of polishing a workpiece by CMP in the process of manufacturing semiconductor devices uses a polishing slurry containing a fumed silica abrasive or colloidal silica abrasive. The slurry is placed on a hard elastic polishing pad made of polyurethane foam, and the workpiece is slid against the polishing pad. The above-mentioned type of abrasive is used because major insulating layers of semiconductor devices are made of silica or a silica-based material.

For a polishing process of these days, however, a polishing slurry containing a cerium dioxide abrasive is sometimes used for the purpose of achieving a suitable removal selectivity ratio between silica and a substance other than silica that coexists with silica through an inter-solid reaction with silica. Also, a polishing slurry containing an organic or inorganic acid or oxidant is sometimes used in an embedding and polishing process called "damascene process" for wiring formation, because the material to be removed by polishing in that process is usually a metal such as copper or tungsten. Another technique commonly employed in a polishing process of these days is to apply a relatively high load onto the retainer ring separately from the workpiece to be polished, to thereby control the polishing profile near the outer edge of the workpiece. The retainer ring used in such a polishing process tends to have a shorter life due to a reduction in chemical resistance and an increase in amount of mechanical abrasion of the retainer ring.

When a surface of the structure for magnetic-head manufacture is polished by CMP for planarization, the material to be removed by polishing is mainly alumina ($Al_2O_3$). In this case, typically used is a polishing slurry that contains $\alpha$-alumina or $\gamma$-alumina as an abrasive. The abrasion amount of the retainer ring in this case is several to ten-and-several times greater than that in a polishing process for manufacturing semiconductor devices that primarily uses a silica abrasive. As a result, the life of the retainer ring is considerably shorter.

To cope with such circumstances, various attempts have been made to extend the life of the retainer ring. For example, JP 2002-355753A discloses a retainer ring made up of a combination of a resin layer portion that is formed of a synthetic resin material and a ceramic layer portion that is formed of a ceramic material having a high abrasion resistance, such as silicon carbide, alumina, silicon nitride, sialon, forsterite, steatite, or cordierite.

JP 2007-301713A discloses a retainer ring that includes a base part and a diamond-like-carbon film formed on the surface of the base part.

JP 2006-004992A discloses a technique of calculating the remaining life of a retainer ring based on information on at least one of the pressing force of a polishing-head pressing means, the rotation speed of a rotary platen and the rotation speed of a polishing head, and information on at least one of the period of time over which polishing is performed with a polishing pad and the number of times of polishing performed with the polishing pad.

In the polishing process in manufacturing semiconductor devices, however, if a retainer ring having a hard surface such as one described in JP 2007-301713A is used to retain a structure including a single crystal silicon wafer to polish the structure, chipping may occur at the outer edge of the wafer during the polishing, which may develop into a crack along the crystal orientation of the wafer and thereby damage the wafer. The retainer ring disclosed in JP 2002-355753A can prevent the occurrence of chipping at the outer edge of the wafer because the outer edge of the wafer comes in contact with the resin layer portion. However, this retainer ring is expensive because of its composite structure having the ceramic portion and the resin layer portion.

The technique disclosed in JP 2006-004992A allows calculation of the remaining life of the retainer ring, but cannot extend the life of the retainer ring.

As described above, when a surface of the structure for magnetic-head manufacture is polished by CMP, the life of the retainer ring is shorter than that in a polishing process in manufacturing semiconductor devices. Conventionally, however, no considerations have been made concerning how to achieve a longer life of the retainer ring used in polishing the surface of the structure for magnetic-head manufacture by CMP.

OBJECT AND SUMMARY OF THE INVENTION

It is an object of the present invention to provide a retainer ring that achieves a longer life while preventing the occurrence of chipping in a structure for magnetic-head manufacture when a surface of the structure is polished by chemical mechanical polishing, and to provide a method of polishing the structure by using such a retainer ring.

A retainer ring of the present invention is for use in the process of manufacturing a magnetic head using a ceramic substrate made of a ceramic material containing alumina-titanium carbide. The retainer ring is intended for retaining a structure for magnetic-head manufacture when a surface of the structure is polished by chemical mechanical polishing. The structure for magnetic-head manufacture includes the ceramic substrate and one or more layers formed thereon, and has the surface to be polished. The retainer ring is made of a ceramic material containing alumina-titanium carbide. According to the present invention, the "ceramic material containing alumina-titanium carbide" shall include a ceramic material composed only of alumina-titanium carbide, as well as a ceramic material that contains alumina-titanium carbide as a main component and additionally contains another ceramic and/or material(s) other than ceramic.

In the retainer ring of the present invention, the alumina-titanium carbide contained in the ceramic material of which the retainer ring is made may contain 50 to 80 wt % of alumina and a balance of titanium carbide.

A polishing method of the present invention is a method of polishing a surface of a structure for magnetic-head manufacture by chemical mechanical polishing in the process of manufacturing a magnetic head using a ceramic substrate made of a ceramic material containing alumina-titanium carbide. The structure for magnetic-head manufacture includes the ceramic substrate and one or more layers formed thereon, and has the surface to be polished. The polishing method of the present invention includes the steps of: retaining the structure on a polishing pad by using a retainer ring made of a ceramic material containing alumina-titanium carbide, such that the surface to be polished of the structure faces the polishing pad; and polishing the surface to be polished of the structure retained by the retainer ring by using the polishing pad and a polishing slurry placed on the polishing pad.

In the polishing method of the present invention, the alumina-titanium carbide contained in the ceramic material of which the retainer ring is made may contain 50 to 80 wt % of alumina and a balance of titanium carbide.

In the polishing method of the present invention, at least part of the surface to be polished may be formed of an alumina layer.

According to the retainer ring and the polishing method of the present invention, when a surface of the structure for magnetic-head manufacture that includes the ceramic substrate is polished by chemical mechanical polishing, it is possible to achieve a longer life of the retainer ring used to retain the structure and also possible to prevent the occurrence of chipping in the structure, because the retainer ring is made of a ceramic material containing alumina-titanium carbide, as is the ceramic substrate.

Other and further objects, features and advantages of the invention will appear more fully from the following description.

DETAILED DESCRIPTION OF THE PREFERRED EMBODIMENT

Figure 1:
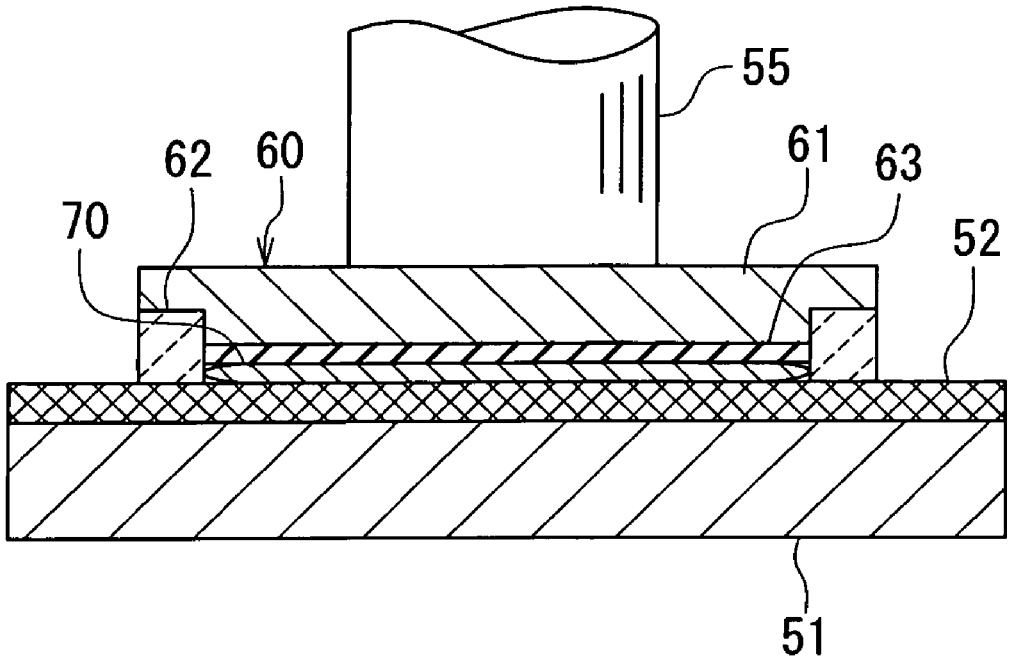
FIG. 1 is a cross-sectional view illustrating a main part of a polishing apparatus used in a polishing method of an embodiment of the invention.

An embodiment of the present invention will now be described in detail with reference to the drawings. Reference is first made to FIG. 1 to describe an example of the configuration of a polishing apparatus for use in a polishing method of the embodiment of the invention. The polishing apparatus shown in FIG. 1 is an apparatus for performing CMP. This polishing apparatus includes: a platen 51 to be driven to rotate; a polishing pad 52 provided on the platen 51; a rotary drive shaft 55 provided above the polishing pad 52 and extending in the vertical direction; and a polishing head 60 attached to the lower end of the rotary drive shaft 55. The polishing head 60 is disposed on the polishing pad 52.

The polishing head 60 includes: a top plate 61 that is shaped like a disk and fixed to the lower end of the rotary drive shaft 55; a retainer ring 62 of the present embodiment that is fixed to the lower surface of the top plate 61; and a backing pad 63 that is formed of an elastic material and disposed in the space surrounded by the top plate 61 and the retainer ring 62. The retainer ring 62 is cylinder-shaped. A workpiece to be polished is placed below the backing pad 63 in the space surrounded by the top plate 61 and the retainer ring 62.

In the polishing method of the present embodiment, a structure for magnetic-head manufacture (hereinafter simply referred to as "structure") 70 is polished with the polishing apparatus shown in FIG. 1. The structure 70 is formed in the process of manufacturing a magnetic head using a ceramic substrate that is made of a ceramic material containing alumina-titanium carbide. The structure 70 includes the ceramic substrate and one or more layers formed thereon, and has a surface to be polished.

To polish the structure 70 with the polishing apparatus of FIG. 1, the structure 70 is placed below the backing pad 63 in the space surrounded by the top plate 61 and the retainer ring 62, such that the surface to be polished of the structure 70 faces downward. The structure 70 is thereby pressed against the polishing pad 52 by the backing pad 63. The retainer ring 62 retains the structure 70 on the polishing pad 52 so as to prevent the structure 70 from becoming detached from the polishing head 60 during polishing of the structure 70.

When polishing the structure 70 with the polishing apparatus of FIG. 1, a polishing slurry is put on the polishing pad 52, and the platen 51 and the polishing pad 52 are driven to rotate. The rotary drive shaft 55 is also driven to rotate by a driving device that is not shown, so that the polishing head 60 is also driven to rotate. The surface to be polished of the structure 70 is thus polished by the polishing pad 52 and the slurry.

The polishing apparatus for use in the polishing method of the present embodiment may have a configuration other than that shown in FIG. 1. For example, the polishing apparatus may be configured to have an elastomer film in place of the backing pad 63 and to supply air or water to the space between the top plate 61 and the elastomer film so that a workpiece to be polished is pressed against the polishing pad 52 by means of the air pressure or water pressure. The polishing apparatus may also be configured so that the polishing head 60 is driven to rotate on a belt-shaped polishing pad that is driven in the horizontal direction.

The top plate 61 may have a down-force distribution generating mechanism for controlling the profile of the surface of the workpiece being polished. The top plate 61 may further have a mechanism capable of applying down force to the retainer ring 62 separately from the workpiece. When the retainer ring 62 of the present embodiment is used with the polishing head 60 where the top plate 61 has such a mechanism, the advantage of the retainer ring 62 in that it provides a longer life, as will be described in detail later, becomes more noticeable. The retainer ring 62 may be grooved so as to promote the action of the polishing slurry on the workpiece.

The retainer ring 62 of the present embodiment is made of a ceramic material containing alumina-titanium carbide (hereinafter referred to as AlTiC). AlTiC is ceramic that contains alumina and titanium carbide. The ceramic material containing AlTiC may be a material composed only of AlTiC, or may be a material that contains AlTiC as a main component and additionally contains another ceramic and/or material(s) other than ceramic. Here, if the AlTiC contained in the ceramic material that forms the retainer ring 62 has an alumina content higher than necessary, the retainer ring 62 cannot provide a sufficient resistance to abrasion. On the other hand, if the AlTiC contained in the ceramic material that forms the retainer ring 62 has a titanium carbide content higher than necessary, chipping can occur in the structure 70 during polishing, or polishing flaws can occur on the surface of the structure 70. In consideration of these, the AlTiC contained in the ceramic material that forms the retainer ring 62 preferably contains 50 to 80 wt % of alumina and the remaining 20 to 50 wt % of titanium carbide.

The polishing method of the present embodiment will now be described. The polishing method of the embodiment is a method of polishing a surface of the structure 70 by CMP in the process of manufacturing a magnetic head using a ceramic substrate that is made of a ceramic material containing AlTiC (this substrate will be hereinafter referred to as "AlTiC substrate"). The structure 70 includes the AlTiC substrate and one or more layers formed thereon, and has the surface to be polished. The polishing method of the embodiment includes the steps of: retaining the structure 70 on the polishing pad 52 by using the retainer ring 62 made of a ceramic material containing AlTiC, such that the surface to be polished of the structure 70 faces the polishing pad 52; and polishing the surface to be polished of the structure 70 retained by the retainer ring 62 by using the polishing pad 52 and a polishing slurry placed on the polishing pad 52. In the present embodiment, at least part of the surface to be polished may be formed of an alumina layer. In addition, the polishing slurry used in the present embodiment preferably contains an alumina abrasive.

Figure 2:
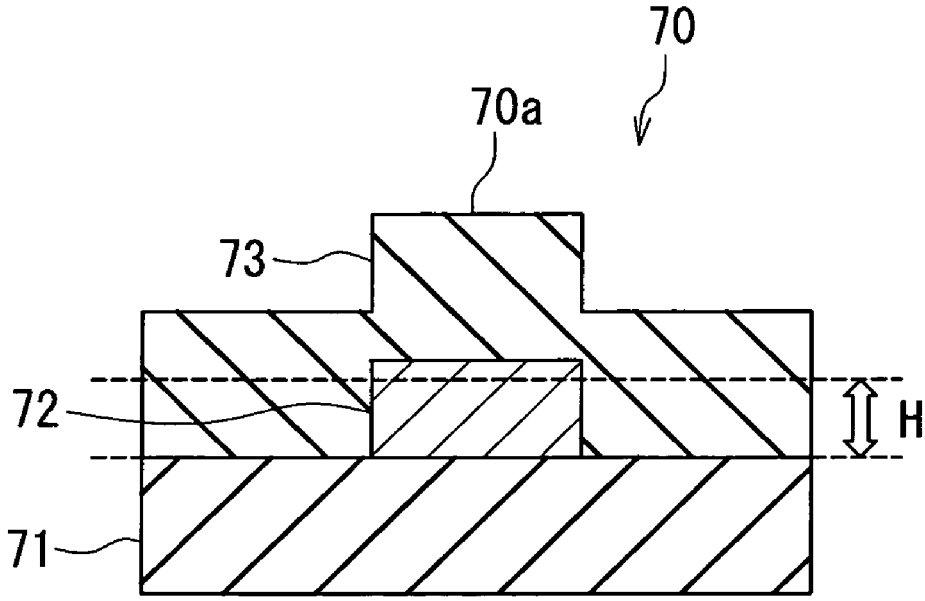
FIG. 2 is an illustrative view for explaining the polishing method of the embodiment of the invention.

FIG. 2 illustrates a portion of an example of the structure 70 to be polished by the polishing method of the present embodiment. The structure 70 of this example includes an insulating layer 71 made of alumina, for example. The insulating layer 71 is provided on or above the AlTiC substrate (not shown) either directly or with at least one other layer disposed between the AlTiC substrate and the insulating layer 71. The structure 70 further includes a patterned layer 72 formed on the insulating layer 71. The patterned layer 72 is formed of a magnetic metal material or a nonmagnetic metal material, for example. The patterned layer 72 is formed into a predetermined shape through the use of known film-forming and patterning techniques such as lithography, sputtering, and plating. A specific example of the patterned layer 72 will be described later.

The structure 70 further includes an insulating layer 73 that is made of, for example, alumina, and formed on the insulating layer 71 and the patterned layer 72 such that the patterned layer 72 is completely or partially covered. For example, when the patterned layer 72 is made of a magnetic material and is therefore susceptible to heat, the insulating layer 73 is formed typically by sputtering. In this case, cracking may occur in the insulating layer 73 due to a corner portion formed by the top surface of the insulating layer 71 and a side surface of the patterned layer 72. To cope with this, as necessary, an underlying alumina thin film may be formed in advance by low-temperature chemical vapor deposition, for example, before the insulating layer 73 is formed by sputtering alumina.

A surface of the insulating layer 73 has a step (projection) resulting from the patterned layer 72. This surface of the insulating layer 73 is the surface to be polished 70*a* of the structure 70. The thickness of the insulating layer 73 as initially formed varies depending on the stock removal required for reducing the step height of the surface 70*a* to a tolerable level in the polishing process to be performed later. In most cases, the insulating layer 73 is formed to have an initial thickness that is two to three times greater than the difference in level between the top surface of the patterned layer 72 and the top surface of the insulating layer 71.

In the polishing method of the present embodiment, the surface to be polished 70*a* of the structure 70 is polished by CMP for planarization. In FIG. 2, "H" indicates the thickness of each of the patterned layer 72 and the insulating layer 73 after polishing. FIG. 2 shows an example in which the thickness H is smaller than the initial thickness of the patterned layer 72. In this case, the patterned layer 72 and the insulating layer 73 both appear at the surface of the structure 70 after the polishing. However, the thickness H may be made equal to the initial thickness of the patterned layer 72 so that the patterned layer 72 and the insulating layer 73 both appear at the surface of the structure 70 after the polishing, or the thickness H may be made greater than the initial thickness of the patterned layer 72 so that only the insulating layer 73 appears at the surface of the structure 70 after the polishing. The thickness H is appropriately determined according to the function of the patterned layer 72 and the purpose of polishing of the surface 70*a*.

On the surface of the structure 70 after polishing, a layer to be used for fabrication of the magnetic head is formed by lithography or the like. It is therefore required that the surface of the structure 70 after polishing have such an evenness that there will be no problem in forming such a layer on the surface by lithography or the like.

In the polishing method of the present embodiment, when the structure 70 that has the surface to be polished 70*a* and includes the AlTiC substrate and one or more layers formed thereon is polished by CMP at the surface 70*a*, the retainer ring 62 made of a ceramic material containing AlTiC is used to retain the structure 70. Compared with a typical retainer ring made of PPS or PEEK, the retainer ring 62 made of a ceramic material containing AlTiC has a much higher resistance to abrasion and thus has a much longer life. More specifically, as will be demonstrated by experimental results shown later, the life of the retainer ring 62 of the present embodiment is 5000 or more times longer than that of a typical retainer ring made of PPS or PEEK. Accordingly, the use of the retainer ring 62 of the present embodiment in polishing the structure 70 allows a great reduction in cost for the retainer ring that is included in the running costs for the polishing process.

Generally, it is not preferable to use a retainer ring at a period near the end of its life because polishing precision is unstable at that period. For the case of the retainer ring 62 of the present embodiment used in polishing the structure 70, however, the retainer ring 62 has a long life and is therefore capable of being used for a satisfactorily long period of time, which eliminates the need for using it at the period near the end of its life.

The retainer ring 62 of the present embodiment is made of a ceramic material containing AlTiC, which is the same as the material of the substrate of the structure 70. The hardness of the retainer ring 62 is therefore equivalent to that of the substrate of the structure 70. Consequently, according to the embodiment, it is possible to prevent the occurrence of chipping at the outer edge of the structure 70 during polishing.

While the retainer ring 62 of the present embodiment is suitable for use to polish the structure 70 including the AlTiC substrate, it is not suitable for use to polish a structure including a single crystal silicon wafer. This is because, if a structure including a single crystal silicon wafer is polished using the retainer ring 62 of the embodiment, chipping may occur at the outer edge of the wafer during the polishing, which may develop into a crack along the crystal orientation of the wafer and thereby damage the wafer.

In contrast, when the structure 70 including the AlTiC substrate is polished using the retainer ring 62 of the embodiment, the substrate will not suffer any damage that results from being made of a single crystal like a single crystal silicon wafer, because the substrate of the structure 70 is made of a ceramic material and not a single crystal.

In the case of polishing the structure 70 including the AlTiC substrate, however, if a retainer ring made of a material harder than AlTiC such as silicon carbide (SiC) is used, chipping is more likely to occur at the outer edge of the AlTiC substrate during the polishing. For use in polishing the structure 70 including the AlTiC substrate, the most suitable material for the retainer ring is therefore a ceramic material containing AlTiC.

The AlTiC contained in the ceramic material that forms the retainer ring 62 is composed mainly of alumina. Therefore, if at least part of the surface to be polished 70*a* of the structure 70 is formed of an alumina layer, it is possible to suppress the occurrence of contamination or polishing flaws on the surface during polishing that may result from the use of the retainer ring 62.

The following is a description of the results of a first experiment that demonstrate the advantageous effects of the retainer ring 62 and the polishing method according to the present embodiment. In the first experiment, test specimens of Example 1 and Comparative examples 1 through 9 were prepared and they were polished with a polishing slurry for use in polishing alumina thin films, i.e., a polishing slurry containing an alumina abrasive, to determine the abrasion rate for each specimen. In this experiment, furthermore, a specimen of Comparative example 10 was prepared and polished with a polishing slurry for use in polishing silica thin films, i.e., a polishing slurry containing a silica abrasive, and the abrasion rate of the specimen was determined. The specimens of Example 1 and Comparative examples 1 through 10 were all 25 mm long, 25 mm wide, and 2 mm thick.

The specimen of Example 1 was fabricated by cutting a plate of AlTiC containing 65 wt % of alumina and 35 wt % of titanium carbide. The specimens of Comparative examples 1 through 10 were fabricated by cutting plates of the following materials. The material of the specimen of Comparative example 1 was alumina. The material of the specimen of Comparative example 2 was SiC. The material of the specimen of Comparative example 3 was PPS. The material of the specimen of Comparative example 4 was PEEK. The material of the specimen of Comparative example 5 was polyparaphenylene (hereinafter referred to as PPP). The material of the specimen of Comparative example 6 was PEEK containing a solid lubricant (GYTILON 1330 (product name) manufactured by Greene, Tweed & Co., Japan, hereinafter referred to as PEEK+). The material of the specimen of Comparative example 7 was tungsten carbide (hereinafter referred to as WC). The material of the specimen of Comparative example 8 was a tungsten carbide alloy (FP-360 (product name) manufactured by Fukuda Metal Foil & Powder Co., Ltd., hereinafter referred to as WC+). The material of the specimen of Comparative example 9 was a nickel alloy (FP-6 (product name) manufactured by Fukuda Metal Foil & Powder Co., Ltd., hereinafter referred to as Ni+). The material of the specimen of Comparative example 10 was PPS.

Ni+ is an Ni alloy containing 14.7 wt % of Cr, 3 wt % of B, 4.3 wt % of Si, 0.7 wt % of C, and 3 wt % of Fe. WC+ is an alloy containing WC and Ni+.

The polishing conditions for the specimens of Example 1 and Comparative examples 1 through 9 in the first experiment were as follows. The polishing apparatus used was a table top lapping machine (Lapmaster 25 (product name) manufactured by Lapmaster SFT Corporation). The polishing pad used was IC-1400 Pad D 23" F9; XA01 A2 (product name) manufactured by Nitta Haas Incorporated. The polishing slurry used was BIKALOX alumina slurry Type KZ-50 (product name) manufactured by Baikowski Japan Co., Ltd, which is a slurry for use in polishing alumina thin films, i.e., a slurry containing an alumina abrasive. The polishing down force applied was 27.9 kPa (281.2 g/cm$^2$). The linear velocity of the platen at the center of the surface to be polished of each specimen was 30.0 m/min.

The polishing conditions for the specimen of Comparative example 10 in the first experiment were the same as those for the specimens of Example 1 and Comparative examples 1 through 9 except that the polishing slurry used for Comparative example 10 was SS-12 (product name) manufactured by Cabot Microelectronics Japan KK, which is a slurry for use in polishing silica thin films, i.e., a slurry containing a silica abrasive.

In the first experiment, the specimens of Example 1 and Comparative examples 1 through 10 were each accurately weighed before and after the polishing so as to determine the abrasion rate for each specimen. Table 1 shows the results of the first experiment. In Table 1, the column entitled "Material" lists the materials of the specimens; the column entitled "Spec. gravity" lists the specific gravities of the materials of the specimens; the column entitled "Weight before polishing" lists the weights (in grams) of the specimens before polishing; the column entitled "Weight after polishing" lists the weights (in grams) of the specimens after polishing; and the column entitled "Polishing time" lists the polishing times (in hours) for the specimens. Furthermore, in Table 1, the column entitled "Abrasion rate" lists the abrasion rates ($cm^3$/hour× 0.001) of the specimens. The abrasion rate of each specimen was determined by calculation based on the specimen's dimensions, specific gravity, weight before polishing, weight after polishing, and polishing time. Furthermore, the column entitled "Relative life" in Table 1 lists the relative lives of the specimens when the life of the specimen of Comparative example 3 is taken as 1. The relative life was determined by dividing the abrasion rate of the specimen of Comparative example 3 by the abrasion rate of each of the other specimens. The relative life can be considered to represent the abrasion resistance.

TABLE 1

| | Material | Spec. gravity | Weight before polishing (g) | Weight after polishing (g) | Polishing time (Hr) | Abrasion rate ($cm^3$/Hr × 0.001) | Relative life |
|---|---|---|---|---|---|---|---|
| Example 1 | AlTiC | 4.24 | 5.0849 | 5.0847 | 5 | 0.0094 | 6916.4346 |
| Comparative example 1 | $Al_2O_3$ | 3.97 | 4.7153 | 4.7106 | 5 | 0.2368 | 275.5745 |
| Comparative example 2 | SiC | 3.20 | 3.8329 | 3.8291 | 5 | 0.2375 | 274.7342 |
| Comparative example 3 | PPS | 1.35 | 4.1411 | 3.7006 | 5 | 65.2494 | 1.0000 |
| Comparative example 4 | PEEK | 1.32 | 3.9721 | 3.7998 | 2 | 65.2525 | 1.0000 |
| Comparative example 5 | PPP | 1.21 | 3.6649 | 3.6521 | 2 | 5.3030 | 12.3042 |
| Comparative example 6 | PEEK+ | 1.38 | 1.7141 | 1.7009 | 2 | 4.7585 | 13.7123 |
| Comparative example 7 | WC | 15.6 | 16.7147 | 16.5722 | 5 | 1.8274 | 35.7071 |
| Comparative example 8 | WC+ | 11.0 | 17.1079 | 16.7162 | 5 | 7.1224 | 9.1611 |
| Comparative example 9 | Ni+ | 7.85 | 17.4994 | 17.4489 | 5 | 1.2866 | 50.7136 |
| Comparative example 10 | PPS | 1.35 | 4.5032 | 4.4957 | 0.5 | 11.2193 | 5.8158 |

The experimental results shown in Table 1 demonstrate that the abrasion resistance (relative life) of the specimen of Example 1 is approximately 25 to 7000 times that of the specimens of Comparative examples 1 through 9. The abrasion rates of the specimens of Comparative examples 3 and 4 indicate that PPS and PEEK commonly used as the material of a retainer ring for use in polishing a structure including a silicon wafer suffer very high abrasion rates. Furthermore, as can be seen from a comparison of abrasion rates between the specimens of Comparative examples 3 and 10, PPS and PEEK suffer a higher abrasion rate when polished with a polishing slurry containing an alumina abrasive than when polished with a polishing slurry containing a silica abrasive. This indicates that PPS and PEEK, which are commonly used as the material of a retainer ring for use in polishing a structure including a silicon wafer, are not suitable as the material of a retainer ring for use in polishing the structure 70 that includes an AlTiC substrate.

As can be seen from the results shown in Table 1, when polished with a polishing slurry containing an alumina abrasive, AlTiC exhibits an abrasion resistance (relative life) approximately 25 to 7000 times that of the other materials listed in Table 1. Therefore, when used with a polishing slurry containing an alumina abrasive to polish a workpiece, the retainer ring 62 of the present embodiment, which is made of a ceramic material containing AlTiC, has a life that is several to several thousand times longer than that of a retainer ring made of other materials listed in Table 1. In particular, the life of the retainer ring 62 of the present embodiment is 5000 times that of a retainer ring made of PPS or PEEK, when used with a polishing slurry containing an alumina abrasive to polish a workpiece.

The following is a description of the results of a second experiment that further demonstrate the advantageous effects of the retainer ring 62 and the polishing method according to the present embodiment. For the second experiment, a retainer ring of Example 2 and a retainer ring of Comparative example 11 were prepared. These retainer rings both have a size intended for polishing a 6-inch wafer. The retainer ring of Example 2 was fabricated by cutting a block of AlTiC containing 65 wt % of alumina and 35 wt % of titanium carbide. The retainer ring of Comparative example 11 was fabricated by cutting a block of PEEK.

In the second experiment, the retainer ring of Example 2 was used to polish a structure continuously under the conditions described below, and the retainer ring of Comparative example 11 was used to polish a structure continuously under the same conditions as those for the retainer ring of Example 2. The polishing conditions of the second experiment were as follows. The polishing apparatus used was a multiple single-water type CMP apparatus (ChaMP232C manufactured by Tokyo Seimitsu Co., Ltd.). The structure to be polished was one comprising a 6-inch AlTiC substrate with an oriental flat and a 5-μm alumina film formed on the substrate. The polishing pad used was IC-1400 Pad D 23" F9; XA01 A2 (product name) manufactured by Nitta Haas Incorporated. The polishing slurry used was MSW1500 (product name) manufactured by Nitta Haas Incorporated, which is a slurry for use in polishing alumina thin films, i.e., a slurry containing an alumina abrasive. The polishing down force applied was 13.8 kPa (140.6 g/cm$^2$). The linear velocity of the platen at the center of the surface to be polished of the structure was 80.0 m/min.

In the second experiment, the removal rate distribution of the alumina film in the polishing-receiving surface of each structure was determined at the time point immediately after the start of use of each retainer ring and at the time point at which the retainer ring has been used for 2500 hours. Using an optical film thickness meter (NanoSpec Model 9200 (product name) manufactured by Nanometrix Japan Ltd.), the thickness of the structure was measured at multiple points within the polishing-receiving surface of the structure before and after the polishing performed for a predetermined period of time, and the removal rate distribution was then determined from the amount of change in thickness of the structure at each of the multiple points between before and after the polishing performed for the predetermined period of time.

Figure 3:
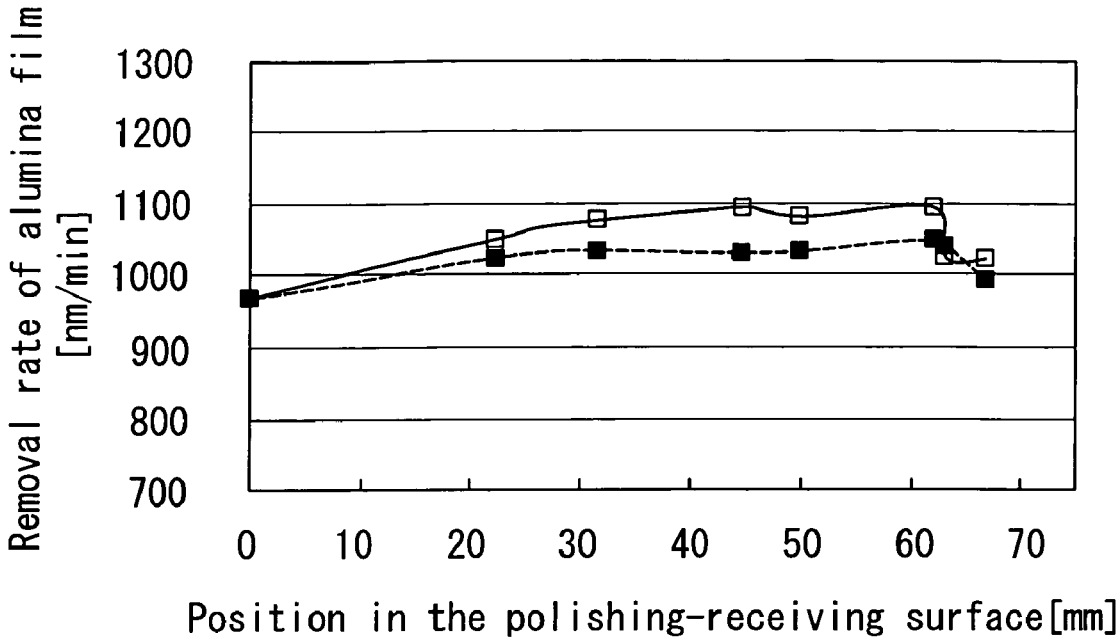
FIG. 3 is a plot showing a change in removal rate distribution of alumina film in the polishing-receiving surface in the case of using a retainer ring of Example.
Figure 4:
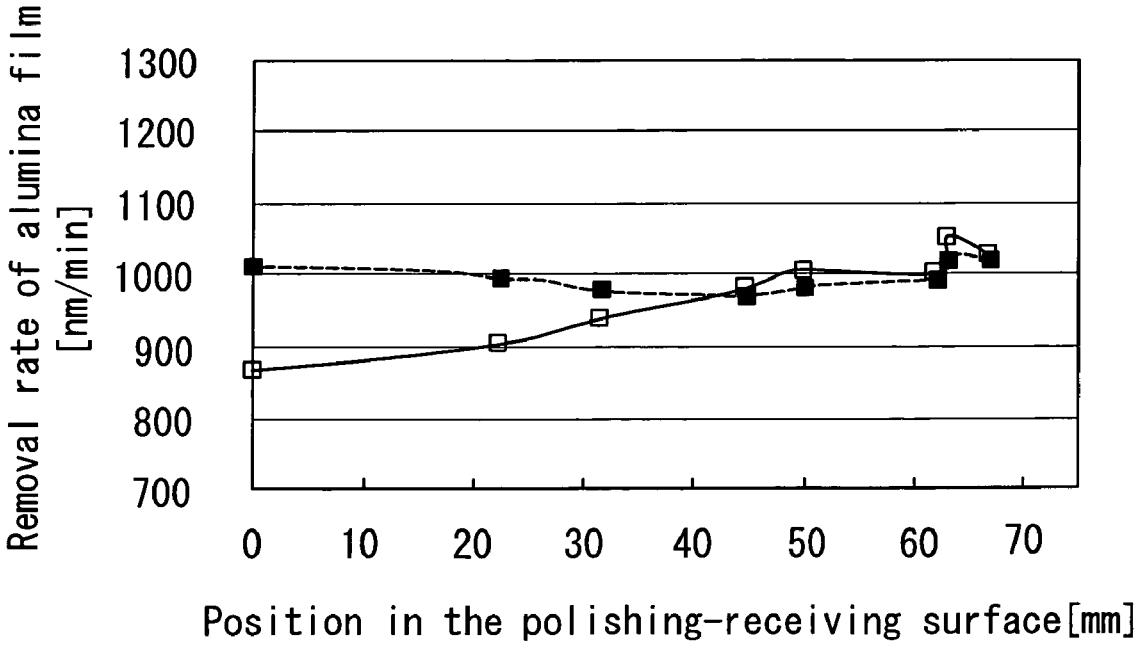
FIG. 4 is a plot showing a change in removal rate distribution of alumina film in the polishing-receiving surface in the case of using a retainer ring of Comparative example.

FIG. 3 and FIG. 4 show the results of the second experiment. FIG. 3 shows the removal rate distributions of the alumina film in the polishing-receiving surface in the case of using the retainer ring of Example 2, determined at the time point immediately after the start of use of the retainer ring and at the time point at which the retainer ring has been used for 2500 hours. FIG. 4 shows the removal rate distributions of the alumina film in the polishing-receiving surface in the case of using the retainer ring of Comparative example 11, determined at the time point immediately after the start of use of the retainer ring and at the time point at which the retainer ring has been used for 2500 hours. The horizontal axis in each of FIG. 3 and FIG. 4 represents the position (mm) in the polishing-receiving surface. The position is indicated by the distance from the center of the surface. The vertical axis in each of FIG. 3 and FIG. 4 represents the removal rate (nm/mm) of the alumina film. Solid squares and the broken line connecting the solid squares in each of FIG. 3 and FIG. 4 show the removal rate distribution of the alumina film in the polishing-receiving surface at the time point immediately after the start of use of the retainer ring. Blank squares and the solid line connecting the blank squares in each of FIG. 3 and FIG. 4 show the removal rate distribution of the alumina film in the polishing-receiving surface at the time point at which the retainer ring has been used for 2500 hours.

As can be seen from FIG. 3, in the case of using the retainer ring of Example 2 made of AlTiC, there is no great difference in removal rate distribution of the alumina film between the time point immediately after the start of use of the retainer ring and the time point at which the retainer ring has been used for 2500 hours. This indicates that, in the case of using the retainer ring of Example 2 made of AlTiC, the difference in polishing profile of the surface between the time point immediately after the start of use of the retainer ring and the time point at which the retainer ring has been used for 2500 hours is as slight as within a tolerance. It is also deducible from FIG. 3 that the retainer ring of Example 2 made of AlTiC is not yet at the end of its life even at the time point at which it has been used for 2500 hours. Furthermore, none of the structures that were polished using the retainer ring of Example 2 showed any chipping or damage.

In contrast, as can be seen from FIG. 4, in the case of using the retainer ring of Comparative example 11 made of PEEK, the removal rate distribution of the alumina film at the time point at which the retainer ring has been used for 2500 hours differs greatly from that at the time point immediately after the start of use of the retainer ring. In particular, it can be seen from FIG. 4 that, in the case of using the retainer ring of Comparative example 11 made of PEEK, at the time point at which the retainer ring has been used for 2500 hours, the removal rate is higher at a portion of the surface near its outer edge than at a portion near its center. This indicates that, in the case of using the retainer ring of Comparative example 11 made of PEEK, the polishing profile of the surface at the time point at which the retainer ring has been used for 2500 hours differs greatly from that at the time point immediately after the start of use of the retainer ring. It is also deducible from FIG. 4 that the life of the retainer ring of Comparative example 11 had expired before the period of its use reached 2500 hours.

The results of the second experiment indicate that, when used in polishing the structure 70 including an AlTiC substrate with a polishing slurry containing an alumina abrasive, the retainer ring 62 of the present embodiment has a longer life compared with a typical retainer ring made of PEEK.

Figure 5:
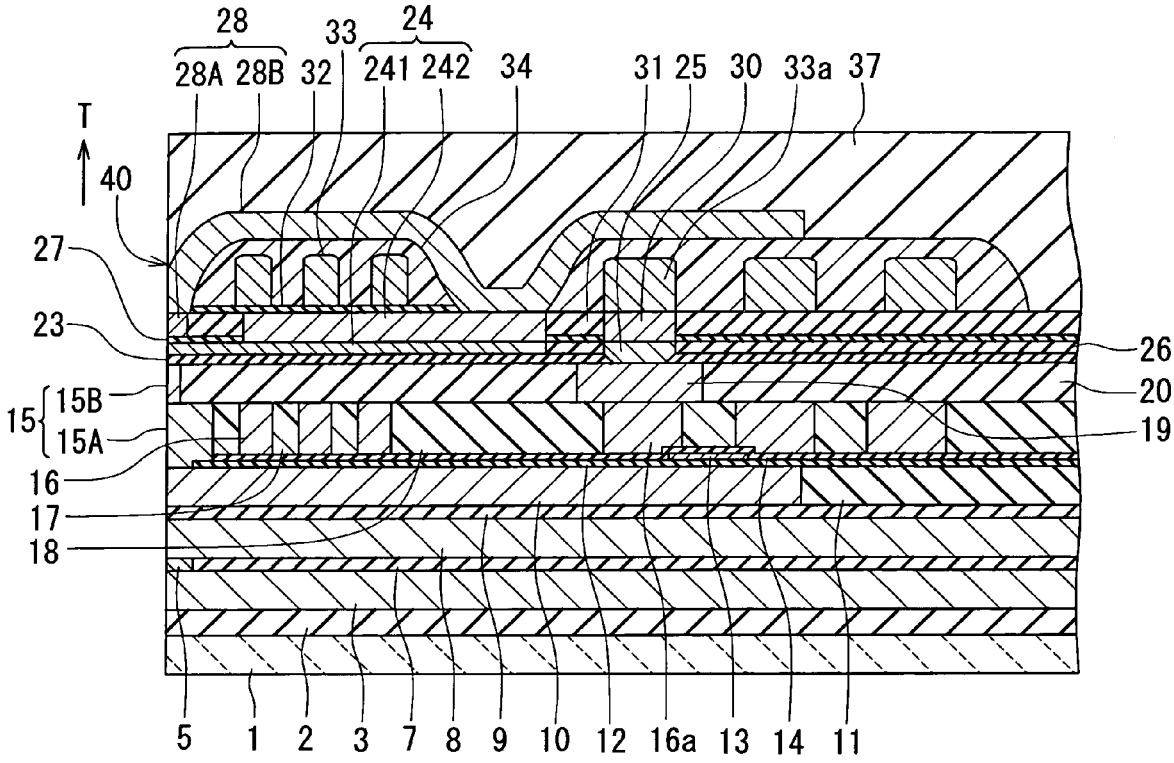
FIG. 5 is a cross-sectional view illustrating an example of a magnetic head to which the polishing method of the embodiment of the invention is applicable.

Reference is now made to FIG. 5 to describe an example of the process of manufacturing a magnetic head to which the retainer ring 62 and the polishing method of the present embodiment are applicable. First, the configuration of the magnetic head shown in FIG. 5 will be described. FIG. 5 is a cross-sectional view illustrating the configuration of the magnetic head. FIG. 5 shows a cross section perpendicular to the medium facing surface and the top surface of the substrate. The arrow marked with T in FIG. 5 shows the direction of travel of a recording medium.

The magnetic head shown in FIG. 5 has the medium facing surface 40 that faces toward the recording medium. The magnetic head includes: an AlTiC substrate 1; an insulating layer 2 made of an insulating material such as alumina and disposed on the substrate 1; a first read shield layer 3 made of a magnetic material and disposed on the insulating layer 2; an MR element 5 disposed on the first read shield layer 3; two bias magnetic field applying layers 6 disposed adjacent to the two sides of the MR element 5, respectively, with insulating films (not shown) respectively disposed therebetween; and an insulating layer 7 disposed around the MR element 5 and the bias magnetic field applying layers 6. The MR element 5 has an end located in the medium facing surface 40. The insulating layer 7 is made of an insulating material such as alumina. The magnetic head further includes: a second read shield layer 8 made of a magnetic material and disposed on the MR element 5, the bias magnetic field applying layers 6 and the insulating layer 7; and a separating layer 9 made of a nonmagnetic material such as alumina and disposed on the second read shield layer 8. The portion from the first read shield layer 3 to the second read shield layer 8 makes up a read head. The second read shield layer 8 may be replaced with a layered film made up of two magnetic layers and a nonmagnetic layer disposed between the two magnetic layers. The nonmagnetic layer is formed of a nonmagnetic material such as ruthenium (Ru) or alumina.

The MR element 5 is, for example, a TMR element utilizing a tunneling magnetoresistive effect. A sense current for detecting a signal magnetic field is fed to the MR element 5 in a direction intersecting the planes of layers constituting the MR element 5, such as the direction perpendicular to the planes of the layers constituting the MR element 5.

The magnetic head further includes: a magnetic layer 10 made of a magnetic material and disposed on the separating layer 9; and an insulating layer 11 made of an insulating material such as alumina and disposed around the magnetic layer 10. The magnetic layer 10 has an end face located in the medium facing surface 40. The top surfaces of the magnetic layer 10 and the insulating layer 11 are planarized.

The magnetic head further includes: an insulating film 12 disposed on the magnetic layer 10 and the insulating layer 11; a heater 13 disposed on the insulating film 12; and an insulating film 14 disposed on the insulating film 12 and the heater 13 such that the heater 13 is sandwiched between the insulating films 12 and 14. The function and material of the heater 13 will be described later. The insulating films 12 and 14 are made of an insulating material such as alumina. An end of each of the insulating films 12 and 14 closer to the medium facing surface 40 is located at a distance from the medium facing surface 40.

The magnetic head further includes a first shield 15 disposed on the magnetic layer 10. The first shield 15 includes: a first layer 15A disposed on the magnetic layer 10; and a second layer 15B disposed on the first layer 15A. The first layer 15A and the second layer 15B are made of a magnetic material. Each of the first layer 15A and the second layer 15B has an end face located in the medium facing surface 40.

The magnetic head further includes: a coil 16 made of a conductive material such as copper and disposed on the insulating film 14; an insulating layer 17 that fills the space between the coil 16 and the first layer 15A and the space between respective adjacent turns of the coil 16; and an insulating layer 18 disposed around the first layer 15A, the coil 16 and the insulating layer 17. The coil 16 is planar spiral-shaped. The coil 16 includes a connecting portion 16*a* that is a portion near an inner end of the coil 16 and connected to another coil described later. The insulating layer 17 is made of photoresist or alumina, for example. The insulating layer 18 is made of alumina, for example. The top surfaces of the first layer 15A, the coil 16, the insulating layer 17 and the insulating layer 18 are planarized.

The magnetic head further includes: a connecting layer 19 made of a conductive material and disposed on the connecting portion 16*a*; and an insulating layer 20 made of an insulating material such as alumina and disposed around the second layer 15B and the connecting layer 19. The connecting layer 19 may be made of the same material as the second layer 15B. The top surfaces of the second layer 15B, the connecting layer 19 and the insulating layer 20 are planarized.

The magnetic head further includes a first gap layer 23 disposed on the second layer 15B, the connecting layer 19 and the insulating layer 20. The first gap layer 23 has an opening formed in a region corresponding to the top surface of the connecting layer 19. The first gap layer 23 is made of a nonmagnetic insulating material such as alumina.

The magnetic head further includes: a pole layer 24 made of a magnetic material and disposed on the first gap layer 23; and a connecting layer 25 made of a conductive material and disposed on the connecting layer 19. The pole layer 24 includes: a first layer 241 disposed on the first gap layer 23; and a second layer 242 disposed on the first layer 241. The first layer 241 has an end face located in the medium facing surface 40. An end face of the second layer 242 closer to the medium facing surface 40 is located at a distance from the medium facing surface 40. The connecting layer 25 may be made of the same material as the first layer 241.

The magnetic head further includes an insulating layer 26 made of an insulating material such as alumina and disposed around the first layer 241 and the connecting layer 25. The connecting layer 25 is connected to the connecting layer 19 through the opening of the first gap layer 23. The top surfaces of the first layer 241, the connecting layer 25 and the insulating layer 26 are planarized.

The magnetic head further includes a second gap layer 27 disposed on the first layer 241 and the insulating layer 26. The second gap layer 27 has an opening for exposing a portion of the top surface of the first layer 241 away from the medium facing surface 40, and an opening for exposing the top surface of the connecting layer 25. The second gap layer 27 is made of a nonmagnetic material such as alumina. The second layer 242 is disposed on the portion of the top surface of the first layer 241 exposed from the opening of the second gap layer 27.

The magnetic head further includes a second shield 28 disposed on the second gap layer 27. The second shield 28 includes: a first layer 28A disposed on the second gap layer 27; and a second layer 28B disposed on the first layer 28A. The first layer 28A and the second layer 28B are made of a magnetic material. Each of the first layer 28A and the second layer 28B has an end face located in the medium facing surface 40.

The magnetic head further includes: a connecting layer 30 made of a conductive material and disposed on the connecting layer 25; and an insulating layer 31 made of an insulating material such as alumina and disposed around the first layer 28A, the second layer 242 and the connecting layer 30. The second layer 242 and the connecting layer 30 may be made of the same material as the first layer 28A. The top surfaces of the first layer 28A, the second layer 242, the connecting layer 30 and the insulating layer 31 are planarized.

The magnetic head further includes an insulating layer 32 made of an insulating material such as alumina and disposed on a portion of the top surface of each of second layer 242 and the insulating layer 31. The top surface of the first layer 28A, a portion of the top surface of the second layer 242 near an end thereof farther from the medium facing surface 40, and the top surface of the insulating layer 30 are not covered with the insulating layer 32.

The magnetic head further includes a coil 33 made of a conductive material such as copper and disposed on the insulating layers 31 and 32. The coil 33 is planar spiral-shaped. The coil 33 includes a connecting portion 33*a* that is a portion near an inner end of the coil 33 and connected to the connecting portion 16*a* of the coil 16. The connecting portion 33*a* is connected to the connecting layer 30, and connected to the connecting portion 16*a* through the connecting layers 19, 25 and 30.

The magnetic head further includes an insulating layer 34 disposed to cover the coil 33. The insulating layer 34 is toroidal in shape with a space formed inside. The insulating layer 34 is made of photoresist or alumina, for example. The second layer 28B of the second shield 28 is disposed on the first layer 28A, the second layer 242 and the insulating layer 34, and connects the first layer 28A and the second layer 242 to each other.

The magnetic head further includes an overcoat layer 37 made of an insulating material such as alumina and disposed to cover the second layer 28B. The portion from the magnetic layer 10 to the second layer 28B makes up a write head.

As described so far, the magnetic head has the medium facing surface 40 that faces toward the recording medium, the read head, and the write head. The read head and the write head are stacked on the substrate 1. The read head is disposed backward along the direction T of travel of the recording medium (that is, disposed closer to the air-inflow end of the slider described later), while the write head is disposed forward along the direction T of travel of the recording medium (that is, disposed closer to the air-outflow end of the slider). The magnetic head writes data on the recording medium through the use of the write head, and reads data stored on the recording medium through the use of the read head.

The read head includes the MR element 5, and the first read shield layer 3 and the second read shield layer 8 that are disposed to sandwich the MR element 5 therebetween. The first read shield layer 3 and the second read shield layer 8 also function as a pair of electrodes for feeding a sense current to the MR element 5 in a direction intersecting the planes of layers constituting the MR element 5, such as the direction perpendicular to the planes of the layers constituting the MR element 5. In addition to the first read shield layer 3 and the second read shield layer 8, another pair of electrodes may be provided on top and bottom of the MR element 5. The MR element 5 has a resistance that changes in response to an external magnetic field, that is, a signal magnetic field sent from the recording medium. The resistance of the MR element 5 can be determined from the sense current. It is thus possible, using the read head, to read data stored on the recording medium.

The MR element 5 is not limited to a TMR element but may be a GMR (giant magnetoresistive) element. The GMR element may be one having a CIP (current-in-plane) structure in which the sense current is fed in a direction nearly parallel to the planes of layers constituting the GMR element, or may be one having a CPP (current-perpendicular-to-plane) structure in which the sense current is fed in a direction intersecting the planes of the layers constituting the GMR element, such as the direction perpendicular to the planes of the layers constituting the GMR element. When the MR element 5 is a GMR element having the CIP structure, a pair of electrodes for feeding the sense current to the MR element 5 are respectively provided on opposite sides of the MR element 5 in the width direction, and shield gap films made of an insulating material are respectively provided between the MR element 5 and the first read shield layer 3 and between the MR element 5 and the second read shield layer 8.

The write head includes the magnetic layer 10, the first shield 15, the coil 16, the first gap layer 23, the pole layer 24, the second gap layer 27, the second shield 28, and the coil 33. The first shield 15 is located closer to the substrate 1 than is the second shield 28.

The coils 16 and 33 generate a magnetic field that corresponds to data to be written on the recording medium. The pole layer 24 has an end face located in the medium facing surface 40, allows a magnetic flux corresponding to the magnetic field generated by the coils 16 and 33 to pass, and generates a write magnetic field used for writing the data on the recording medium by means of a perpendicular magnetic recording system.

The first shield 15 is made of a magnetic material, and has an end face located in the medium facing surface 40 at a position backward of the end face of the pole layer 24 along the direction T of travel of the recording medium. The first gap layer 23 is made of a nonmagnetic material, has an end face located in the medium facing surface 40, and is disposed between the first shield 15 and the pole layer 24. The first shield 15 includes the first layer 15A disposed on the magnetic layer 10, and the second layer 15B disposed on the first layer 15A. Part of the coil 16 is located on a side of the first layer 15A so as to pass through the space between the magnetic layer 10 and the pole layer 24.

The magnetic layer 10 has a function of returning a magnetic flux that has been generated from the end face of the pole layer 24 and that has magnetized the recording medium. FIG. 5 shows an example in which the end face of the magnetic layer 10 is located in the medium facing surface 40. However, since the magnetic layer 10 is connected to the first shield 15 that has the end face located in the medium facing surface 40, the magnetic layer 10 may have an end face that is closer to the medium facing surface 40 and located at a distance from the medium facing surface 40.

In the medium facing surface 40, the end face of the first shield 15 (the end face of the second layer 15B) is located backward of the end face of the pole layer 24 (the end face of the first layer 241) along the direction T of travel of the recording medium (that is, located closer to the air-inflow end of the slider) with a predetermined small distance provided therebetween by the first gap layer 23. The distance between the end face of the pole layer 24 and the end face of the first shield 15 in the medium facing surface 40 is preferably within a range of 0.05 to 0.7 μm, and more preferably within a range of 0.1 to 0.3 μm.

The first shield 15 takes in a magnetic flux that is generated from the end face of the pole layer 24 located in the medium facing surface 40 and that expands in directions except the direction perpendicular to the plane of the recording medium, and thereby prevents this flux from reaching the recording medium. It is thereby possible to improve recording density. However, the first shield 15 is not an essential component of the write head and can be dispensed with.

The second shield 28 is made of a magnetic material, and has an end face located in the medium facing surface 40 at a position forward of the end face of the pole layer 24 along the direction T of travel of the recording medium. The second gap layer 27 is made of a nonmagnetic material, has an end face located in the medium facing surface 40, and is disposed between the second shield 28 and the pole layer 24. The second shield 28 includes the first layer 28A disposed on the second gap layer 27, and the second layer 28B disposed on the first layer 28A. Part of the coil 33 is disposed to pass through the space surrounded by the pole layer 24 and the second shield 28. The second shield 28 is connected to a portion of the pole layer 24 away from the medium facing surface 40. The pole layer 24 and the second shield 28 form a magnetic path that allows a magnetic flux corresponding to the magnetic field generated by the coil 33 to pass therethrough.

In the medium facing surface 40, the end face of the second shield 28 (the end face of the first layer 28A) is located forward of the end face of the pole layer 24 (the end face of the first layer 241) along the direction T of travel of the recording medium (that is, located closer to the air-outflow end of the slider) with a specific small distance provided therebetween by the second gap layer 27. The distance between the end face of the pole layer 24 and the end face of the second shield 28 in the medium facing surface 40 is preferably equal to or smaller than 0.2 μm, and more preferably within a range of 25 to 50 nm.

The position of the end of a bit pattern to be written on the recording medium is determined by the position of an end of the pole layer 24 closer to the second gap layer 27 in the medium facing surface 40. The second shield 28 takes in a magnetic flux that is generated from the end face of the pole layer 24 located in the medium facing surface 40 and that expands in directions except the direction perpendicular to the plane of the recording medium, and thereby prevents this flux from reaching the recording medium. It is thereby possible to improve recording density. Furthermore, the second shield 28 takes in a disturbance magnetic field applied from outside the magnetic head to the magnetic head. It is thereby possible to prevent erroneous writing on the recording medium caused by the disturbance magnetic field intensively taken into the pole layer 24. The second shield 28 also has a function of returning a magnetic flux that has been generated from the end face of the pole layer 24 and has magnetized the recording medium.

FIG. 5 illustrates that neither the magnetic layer 10 nor the first shield 15 is connected to the pole layer 24. However, such a configuration is also possible that the magnetic layer 10 is connected to a portion of the pole layer 24 away from the medium facing surface 40. The coil 16 is not an essential component of the write head and can be dispensed with.

FIG. 5 further illustrates that the pole layer 24 is made up of the first layer 241 and the second layer 242, and the second layer 242 is disposed on the first layer 241, that is, disposed forward of the first layer 241 along the direction T of travel of the recording medium (i.e., closer to the air-outflow end of the slider). However, such a configuration is also possible that the second layer 242 is disposed below the first layer 241, that is, disposed backward of the first layer 241 along the direction T of travel of the recording medium (i.e., closer to the air-inflow end of the slider). The pole layer 24 may be made up of a single layer only.

FIG. 5 further illustrates that the second shield 28 is made up of the first layer 28A and the second layer 28B. However, the second shield 28 may be made up of a single layer only.

The heater 13 is provided for heating the components of the write head including the pole layer 24 so as to control the distance between the recording medium and the end face of the pole layer 24 located in the medium facing surface 40. Two leads that are not shown are connected to the heater 13. The heater 13 is formed of, for example, a NiCr film or a layered film made up of a Ta film, a NiCu film and a Ta film. The heater 13 is energized through the two leads and thereby produces heat so as to heat the components of the write head. As a result, the components of the write head expand and the end face of the pole layer 24 located in the medium facing surface 40 thereby gets closer to the recording medium.

A method of manufacturing the magnetic head shown in FIG. 5 will now be described. In the method of manufacturing the magnetic head, first, components of a plurality of magnetic heads are formed on a single AlTiC substrate to thereby fabricate a substructure in which pre-slider portions each of which will become a slider later are aligned in a plurality of rows. Next, the substructure is cut to form a slider aggregate including a plurality of pre-slider portions aligned in a row. Next, a surface formed in the slider aggregate by cutting the substructure is lapped to thereby form the medium facing surfaces 40 of the pre-slider portions included in the slider aggregate. Next, flying rails are formed in the medium facing surfaces 40. Next, the slider aggregate is cut so as to separate the plurality of pre-slider portions from one another, whereby a plurality of sliders respectively including the magnetic heads are formed.

Attention being drawn to one of the magnetic heads, the method of manufacturing the magnetic head will now be described. In this method, first, the insulating layer 2 is formed on the substrate 1. Next, the first read shield layer 3 is formed on the insulating layer 2. Next, the MR element 5, the two bias magnetic field applying layers 6 and the insulating layer 7 are formed on the first read shield layer 3. Next, the second read shield layer 8 is formed on the MR element 5, the bias magnetic field applying layers 6 and the insulating layer 7. Next, the separating layer 9 is formed on the second read shield layer 8.

Next, the magnetic layer 10 is formed on the separating layer 9 by frame plating, for example. Next, the insulating layer 11 is formed to cover the magnetic layer 10. Next, the insulating layer 11 is polished by CMP until the magnetic layer 10 becomes exposed, so that the top surfaces of the magnetic layer 10 and the insulating layer 11 are planarized. The retainer ring 62 and the polishing method of the present embodiment are used in this step.

Next, the insulating film 12 is formed on the magnetic layer 10 and the insulating layer 11. Next, the heater 13, and the leads (not shown) are formed on the insulating film 12. Next, the insulating film 14 is formed on the insulating film 12, the heater 13 and the leads so as to cover the heater 13 and the leads.

Next, the first layer 15A of the first shield 15 is formed on the magnetic layer 10 by frame plating, for example. Next, the coil 16 is formed on the insulating film 14 by frame plating, for example. Next, the insulating layer 17 is formed so that the space between the coil 16 and the first layer 15A and the space between the respective adjacent turns of the coil 16 are filled with the insulating layer 17.

Next, the insulating layer 18 is formed on the entire top surface of the stack of the layers that have been formed through the foregoing steps. Next, the insulating layer 18 is polished by CMP until the first layer 15A and the coil 16 become exposed, so that the top surfaces of the first layer 15A, the coil 16 and the insulating layer 18 are planarized. The retainer ring 62 and the polishing method of the present embodiment are also used in this step.

Next, the second layer 15B and the connecting layer 19 are formed by frame plating, for example. Next, the insulating layer 20 is formed on the entire top surface of the stack. Next, the insulating layer 20 is polished by CMP until the second layer 15B and the connecting layer 19 become exposed, so that the top surfaces of the second layer 15B, the connecting layer 19 and the insulating layer 20 are planarized. The retainer ring 62 and the polishing method of the present embodiment are also used in this step.

Next, the first gap layer 23 is formed on the entire top surface of the stack. Next, an opening is formed by ion milling, for example, in a region of the first gap layer 23 corresponding to the top surface of the connecting layer 19. Next, a plating layer that will become the first layer 241 of the pole layer 24 later and the connecting layer 25 are formed by frame plating.

Next, the insulating layer 26 is formed on the entire top surface of the stack. Next, the insulating layer 26, the plating layer and the connecting layer 25 are polished by CMP until the connecting layer 25 and the plating layer that is to become the first layer 241 become exposed and these layers achieve desired thicknesses. The top surfaces of the insulating layer 26, the plating layer and the connecting layer 25 are thereby planarized. The plating layer becomes the first layer 241 by being polished to achieve its desired thickness. The retainer ring 62 and the polishing method of the present embodiment are also used in this step.

Next, the second gap layer 27 is formed on the entire top surface of the stack. Next, an opening for exposing a portion of the top surface of the first layer 241 and an opening for exposing the top surface of the connecting layer 25 are formed in the second gap layer 27 by ion milling, for example. Next, the first layer 28A of the second shield 28, the second layer 242 of the pole layer 24, and the connecting layer 30 are formed by frame plating, for example.

Next, the insulating layer 31 is formed on the entire top surface of the stack. Next, the insulating layer 31, the first layer 28A, the second layer 242 and the connecting layer 30 are polished by CMP until the first layer 28A, the second layer 242 and the connecting layer 30 become exposed and these layers achieve desired thicknesses. The top surfaces of the layers 31, 28A, 242 and 30 are thereby planarized. The retainer ring 62 and the polishing method of the present embodiment are also used in this step.

Next, the insulating layer 32 is formed on a portion of the top surface of the second layer 242 and a portion of the top surface of the insulating layer 31. The insulating layer 32 may be formed by etching a portion of an insulating film formed on the entire top surface of the stack, by employing ion milling, for example, or may be formed by lift-off.

Next, the coil 33 is formed. The connecting portion 33*a* of the coil 33 is disposed on the connecting layer 30, and the other portion of the coil 33 is disposed on the insulating layer 32. Next, the insulating layer 34 is formed to cover the coil 33. Next, the second layer 28B is formed by frame plating, for example.

Next, although not shown, bumps for wiring are formed and then the overcoat layer 37 is formed. Next, wiring, terminals and so on are formed on the overcoat layer 37. The substructure is thus fabricated. Next, as previously described, the substructure is cut, the surface to be the medium facing surfaces 40 is lapped to form the medium facing surfaces 40, and flying rails are formed in each medium facing surface 40, whereby the slider including the magnetic head is completed.

The configuration of the magnetic head manufactured through the use of the retainer ring and the polishing method of the present invention is not limited to the one shown in FIG. 5. While the magnetic head shown in FIG. 5 is one for use with a perpendicular magnetic recording system, the present invention is also applicable to the manufacture of a magnetic head for use with a longitudinal magnetic recording system.

It is apparent that the present invention can be carried out in various forms and modifications in the light of the foregoing descriptions. Accordingly, within the scope of the following claims and equivalents thereof, the present invention can be carried out in forms other than the foregoing most preferable embodiments.

What is claimed is:

1. A polishing method for polishing a surface of a structure for magnetic-head manufacture by chemical mechanical polishing in a process of manufacturing a magnetic head using a ceramic substrate made of a ceramic material containing alumina-titanium carbide, the structure including the ceramic substrate and one or more layers formed thereon and having the surface to be polished, the polishing method including the steps of:

retaining the structure on a polishing pad by using a retainer ring made of a ceramic material containing alumina-titanium carbide as the main component, such that the surface to be polished of the structure faces the polishing pad; and polishing the surface to be polished of the structure retained by the retainer ring by using the polishing pad and a polishing slurry placed on the polishing pad.

2. The polishing method according to claim 1, wherein the alumina-titanium carbide contained in the ceramic material of which the retainer ring is made contains 50 to 80 wt % of alumina and a balance of titanium carbide.

3. The polishing method according to claim 1, wherein at least part of the surface to be polished is formed of an alumina layer.

4. The polishing method according to claim 1, wherein the structure for magnetic-head manufacture includes:

a patterned layer that is formed of a metal material; and an insulating layer that is formed of alumina and covers the patterned layer completely or partially;

a surface of the insulating layer having a projection resulting from the patterned layer, wherein the surface of the insulating layer is the surface to be polished; and the surface to be polished is planarized in the step of polishing.

5. A combination of a retainer ring and a structure for magnetic-head manufacture, the retainer ring retaining the structure for magnetic-head manufacture in a process of manufacturing a magnetic head using a ceramic substrate, when a surface of the structure is polished by chemical mechanical polishing, the structure including the ceramic substrate and one or more layers formed thereon and having the surface to be polished, and both the retainer ring and the ceramic substrate being made of a ceramic material containing alumina-titanium carbide.

6. The combination according to claim 5, wherein the alumina-titanium carbide contained in the ceramic material of which the retainer ring is made contains 50 to 80 wt % of alumina and a balance of titanium carbide.

* * * * *